US005082533A

United States Patent [19]

Pulkowski et al.

[11] Patent Number: 5,082,533

[45] Date of Patent: * Jan. 21, 1992

[54] HEATED EXTENDED NIP PRESS WITH POROUS ROLL LAYERS

[75] Inventors: Jeffrey H. Pulkowski, Beloit, Wis.; Elizabeth A. Macklem, Monroe, N.Y.; L. H. Busker, Rockton, Ill.

[73] Assignee: Beloit Corporation, Beloit, Wis.

[ * ] Notice: The portion of the term of this patent subsequent to Nov. 17, 2006 has been disclaimed.

[21] Appl. No.: 641,989

[22] Filed: Jan. 16, 1991

Related U.S. Application Data

[63] Continuation-in-part of Ser. No. 507,321, Apr. 10, 1990, abandoned.

[51] Int. Cl.[5] ..... D21F 3/00; D21F 5/00

[52] U.S. Cl. ..... 162/359; 34/116; 34/123; 100/93 RP; 162/206; 162/358; 162/375

[58] Field of Search ..... 162/290, 206, 207, 358, 162/360.1, 359, 375; 100/38, 93 RP, 93 P; 54/100, 111, 116, 123; 29/121.1, 130

[56] References Cited

U.S. PATENT DOCUMENTS

| | | | |
|---|---|---|---|
| 3,110,612 | 11/1963 | Gottwald et al. | 117/64 |
| 3,296,710 | 1/1967 | Krikorian | 34/95 |
| 3,354,035 | 11/1967 | Gottwald et al. | 162/206 |
| 3,688,688 | 9/1972 | Kerttula et al. | 100/154 |
| 3,797,384 | 3/1974 | Hoff | 100/154 |
| 3,799,052 | 3/1974 | Küsters et al. | 100/93 |
| 3,801,250 | 4/1974 | Kaiser et al. | 425/224 |
| 3,815,256 | 6/1974 | Ely | 34/111 |
| 3,840,429 | 10/1974 | Busker et al. | 162/205 |
| 3,891,376 | 6/1975 | Gersbeck et al. | 425/373 |
| 3,973,483 | 8/1976 | Appenzeller | 100/93 |
| 4,074,441 | 2/1978 | Helversen et al. | 34/122 |
| 4,287,021 | 9/1981 | Justus et al. | 162/358 |
| 4,324,613 | 4/1982 | Wahren | 162/111 |
| 4,334,468 | 6/1982 | Güttinger et al. | 100/93 |
| 4,336,096 | 6/1982 | Dedekind | 156/498 |
| 4,366,025 | 12/1982 | Gordon, Jr. et al. | 162/358 |
| 4,384,514 | 5/1983 | Larive et al. | 100/38 |
| 4,425,190 | 1/1984 | Cronin | 162/358 |
| 4,457,683 | 7/1984 | Gerhardt et al. | 425/373 |
| 4,461,095 | 7/1984 | Lehtinen | 34/41 |
| 4,710,271 | 12/1987 | Miller | 162/360 |
| 4,738,752 | 4/1988 | Busker et al. | 162/359 |
| 4,874,469 | 10/1989 | Pulkowski et al. | 162/359 |

FOREIGN PATENT DOCUMENTS

| | | |
|---|---|---|
| 54206 | 6/1982 | European Pat. Off. . |
| 575453 | 4/1933 | Fed. Rep. of Germany . |
| 803021 | 6/1984 | Finland . |
| 70950 | 7/1986 | Finland . |
| 76608 | 7/1988 | Finland . |
| 7402411 | 3/1979 | Sweden . |
| 2117883 | 10/1983 | United Kingdom . |
| 8503314 | 8/1985 | World Int. Prop. O. . |

*Primary Examiner*—Karen M. Hastings
*Attorney, Agent, or Firm*—Dirk J. Veneman; Raymond W. Campbell; David J. Archer

[57] ABSTRACT

An apparatus and method is disclosed for removing fluid from a fibrous web. The apparatus includes a press member and a blanket which cooperates with the press member for defining therebetween an elongate pressing section such that the web is pressed between the press member and the blanket during passage through the pressing section. An elongate shoe urges the blanket towards the press member such that when the web passes through the pressing section, fluid is removed from the web. A heater is disposed adjacent to the press member for transferring heat to the web such that when the web passes through the press section, the web is subjected for an extended period to increased pressure and temperature so that water vapor generated within the pressing section during passage through the pressing section forces the fluid in the liquid phase away from the web. The press member defines a pressing surface which is porous so that delamination of the web is inhibited.

7 Claims, 2 Drawing Sheets

HEATED EXTENDED NIP PRESS WITH POROUS ROLL LAYERS

CROSS-REFERENCE TO RELATED PATENT APPLICATION

This invention is a continuation-in-part of pending patent application Ser. No. 07/507,321 filed Apr. 10, 1990 now abandoned. All of the disclosure of U.S. Ser. No. 07/507,321 filed Apr. 10, 1990 is incorporated herein by reference.

BACKGROUND OF THE INVENTION

1. Field of the Invention

This invention relates to an apparatus and method for removing fluid from a fibrous web. More particularly, this invention relates to an apparatus and method in which a formed web is subjected for an extended period to increased pressure and temperature such that fluid within the web is removed.

2. Information Disclosure Statement

In the papermaking art, as much water as possible is removed from the formed web in the press section because mechanical removal of fluid at this stage is more economical than subsequent removal of fluid in the drying section of the papermaking machine.

In U.S. Pat. No. 4,738,752, a so-called "high temperature pressing apparatus and method" is disclosed in which the paper web is subjected to a press drying operation for removing most of the water from the fibrous web. The high temperature pressing technique involves the application of high temperatures and pressure to the paper web for an extended period of time. In one embodiment of the high temperature pressing (HTP) process, the web to be dried extends through a press which includes an elongate shoe and a cooperating backing roll. A blanket extends, together with the web, through a pressing section defined between the shoe and the backing roll (or pressing member). The pressing member is inductively, or otherwise, heated such that during passage of the web through the pressing section, fluid within the web is vaporized to force fluid remaining in the liquid phase away from the web.

Because of the very high temperature employed in the aforementioned HTP process coupled with the extremely high pressures, delamination of the formed web has been experienced. Such delamination occurs primarily as the result of the rapid evolution of vapor within the pressing section with such vapor blowing the web apart as the web exits from the pressing section.

The present invention seeks to overcome the aforementioned problem by providing the press member (or backing roll) with a porous layer such that the high pressure vapor within the pressing section diffuses into the porous layer. Additionally, the porous layer tends to reduce thermal transfer between the press member and the web which further inhibits delamination of the pressed web.

Therefore, it is a primary objective of the present invention to overcome the aforementioned problems associated with the aforementioned press drying apparatus and techniques and to provide an apparatus and method which contributes significantly to the press drying art.

Another object of the present invention is the provision of an apparatus for removing fluid from a fibrous web in which the press member defines a pressing surface which is porous.

Another object of the present invention is the provision of an apparatus for removing fluid from a fibrous web in which the press member includes a first and a second coaxial layer with the second coaxial layer extending around the first layer, the second layer defining a cylindrical pressing surface.

Another object of the present invention is the provision of an apparatus for removing fluid from a fibrous web in which the second layer is sintered and has a pore size of at least 2 microns.

Another object of the present invention is the provision of an apparatus for removing fluid from a fibrous web in which the second layer has a thickness of at least 0.005 inches.

Another object of the present invention is the provision of an apparatus for removing fluid from a fibrous web in which the sintered layer is spray-coated onto the first layer which is a backing roll of an extended nip press.

Another object of the present invention is the provision of an apparatus for removing fluid from a fibrous web in which a fiber metal felt is disposed between the press member and the web such that in operation of the apparatus, the metal felt passes with the web through the press section and in which the metal felt is heated immediately prior to the passage of the felt through the pressing section.

Another object of the present invention is the provision of an apparatus for removing fluid from a fibrous web in which a cleaning means is provided for passing a cleaning medium through the metal felt towards a surface of the metal felt contacting the web so that contaminants picked up by the metal felt during operation of the apparatus are ejected from the metal felt.

Another object of the present invention is the provision of an apparatus for removing fluid from a fibrous web in which the first layer of the press member is vented.

Other objects and advantages of the present invention will be apparent to those skilled in the art by consideration of the detailed description contained hereinafter taken in conjunction with the annexed drawings.

SUMMARY OF THE INVENTION

The present invention relates to an apparatus and method for removing fluid from a fibrous web. The apparatus includes a press member and a blanket means which cooperates with the press member for defining therebetween an elongate pressing section such that the web is pressed between the press member and the blanket means during passage through the pressing section. An elongate means urges the blanket means towards the press member such that when the web passes through the pressing section, fluid is removed from the web. A heating means is disposed adjacent to the press member for transferring heat to the web so that when the web passes through the press section, the web is subjected for an extended period to increased pressure and temperature so that water vapor generated within the pressing section during passage through the pressing section forces the fluid in the liquid phase away from the web. The press member defines a pressing surface which is porous such that delamination of the web is inhibited.

In a more specific embodiment of the present invention, the pressing surface is cylindrical and the press member includes a first coaxial layer and a second coaxially layer which extends around the first layer with the second layer defining the cylindrical pressing surface.

The second layer is sintered and has a pore size of at least 2 microns and a thickness of at least 0.005 inches. The second layer may be spray-coated onto the external surface of the first layer which may be an extended nip press backing roll.

In an alternative embodiment of the present invention, the apparatus includes a fiber metal felt which is disposed between the press member and the web such that in operation of the apparatus, the metal felt passes with the web through the press section, the metal felt being heated immediately prior to passage through the press section.

In the alternative embodiment of the present invention, the apparatus also includes cleaning means for cleaning the metal felt. The cleaning means includes means for passing a cleaning medium through the metal felt towards a surface of the metal felt contacting the web so that contaminants picked up by the metal felt during operation of the apparatus are ejected from the metal felt.

In another embodiment of the present invention, the first layer is vented such that fluid entering the porous layer passes through the second layer into the first layer.

In a further embodiment of the present invention, the hot roll includes a first, or inner, solid surface, a second, or outer, layer having a porosity of 20 microns and an intermediate third layer of 100 microns porosity disposed between the first and second layers such that the third layer assists in the ventilation of the roll.

More specifically, the second, or outer, layer has a porosity of 2–50 microns, and in another embodiment of the present invention, the second outer layer extending around the first layer has a pore size of between 0.5–50 microns.

Although the present invention has been described with a certain degree of particularity, it is to be understood by those skilled in the art that the present invention is not limited to the embodiments described in detail hereinafter.

Those skilled in the art will appreciate that many variations and modifications of the present invention may be made without departing from the spirit and scope of the present invention as defined by the appended claims. More specifically, although the present invention provides a porous second layer for inhibiting delamination, it will be apparent to those skilled in the art that in the alternative embodiment of the present invention, the provision of the fiber metal felt may be sufficient to inhibit delamination of the formed web without the need of a porous outer layer on the press member.

Additionally, it will be appreciated by those skilled in the art that the second, or outer, layer may not necessarily be a separate layer but may be etched onto the first layer or otherwise provided by mechanically working the surface of the first layer.

BRIEF DESCRIPTION OF THE DRAWINGS

Similar reference characters refer to similar parts throughout the various embodiments of the present invention.

DETAILED DESCRIPTION OF THE DRAWINGS

Figure 1:
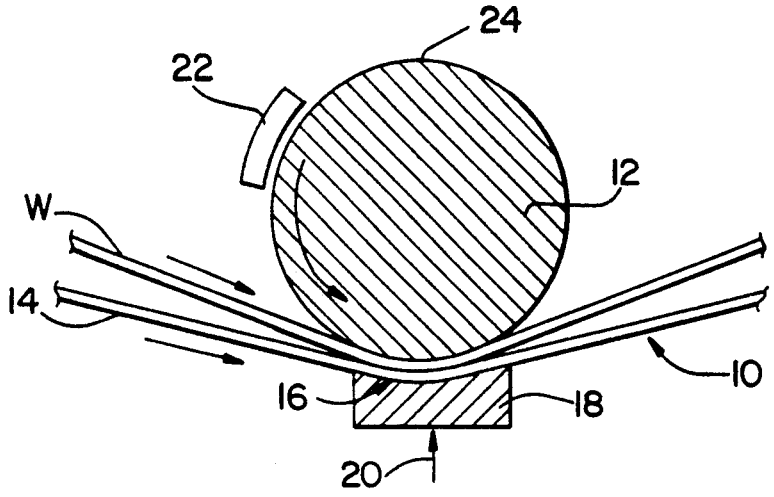
FIG. 1 is a side-elevational view of an apparatus for removing fluid from a fibrous web according to the present invention.

FIG. 1 is a side-elevational view of an apparatus generally designated 10 for removing fluid from a fibrous web W. The apparatus 10 includes a pres member 12 and a blanket means generally designated 14 which cooperates with the press member 12 for defining therebetween an elongate pressing section generally 16 such that the web W is pressed between the press member 12 and the blanket means 14 during passage through the pressing section 16. An elongate means 18, such as an extended nip press shoe, urges the blanket means 14 towards the press member 12 as indicated by the arrow 20 such that when the web W passes through the pressing section 16, fluid is removed from the web W. Heating means generally designated 22 is disposed adjacent to the press member 12 for transferring heat to the web W such that when the web W passes through the press section 16, the web W is subjected for an extended period to increased pressure and temperature so that water vapor generated within the pressing section 16 during passage through the pressing section 16 force the fluid in the liquid phase away from the web W. The press member 12 defines a pressing surface 24 which is porous for inhibiting delamination of the web W. More specifically, as shown in FIG. 1, the pressing surface is cylindrical.

Figure 2:
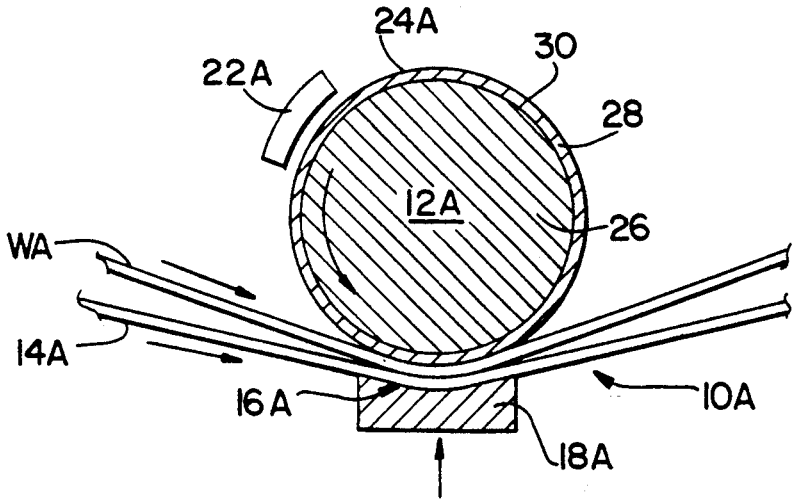
FIG. 2 is a side-elevational view of a second embodiment of the present invention showing the provision of a first and second layer of the press member.

FIG. 2 is a similar view to that shown in FIG. 1 but shows a second embodiment of the present invention in which an apparatus 10A for removing fluid from a fibrous web WA includes a press member 12A in which the press member 12A has a first coaxial layer 26 and a second coaxial layer 28 extending around the first layer 26. The second layer 28 defines a cylindrical pressing surface 24A. The second layer 28, as shown in FIG. 2, may be a sintered layer having a pore size of at least 2 microns. The second layer 28 has a thickness of at least 0.005 inches. Such second layer 28 may be applied to the first layer 26 by a spray-coating technique. The second layer 28 in the aforementioned spray-coating technique, is spray-coated onto the external surface 30 of the first layer 26, the first layer 26 being an extended nip press backing roll.

Preferably, the second layer 28 is applied to the first layer 26 by the aforementioned spray-coating technique in which the specification and performance of the resultant second layer 28 is equivalent to the specification and performance of a plate having a pore size of at least 2 microns and a thickness of at least 0.005 inches.

Figure 3:
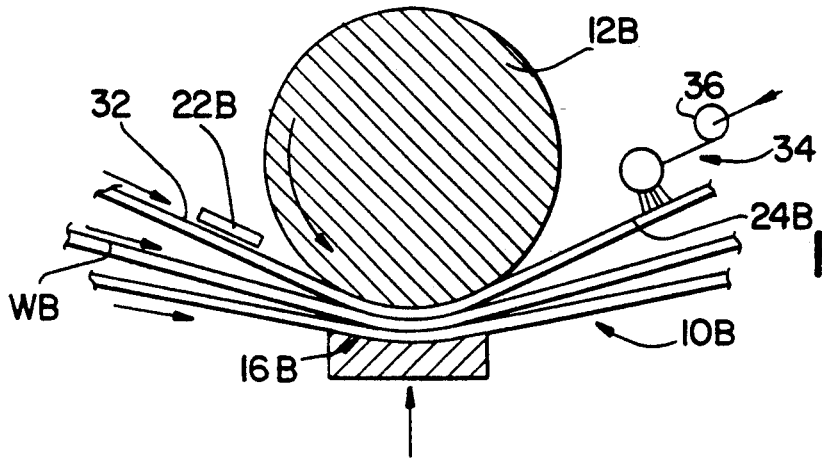
FIG. 3 is a side-elevational view of a third embodiment of the present invention showing a fiber metal felt.

FIG. 3 is a side-elevational view of a third embodiment of the present invention and shows an apparatus 10B for removing fluid from a fibrous web WB. The apparatus 10B includes a fiber metal felt 32 which is disposed between a press member 12B and the web WB such that in operation of the apparatus 10B, the metal felt 32 passes with the web WB through the press section 16B. The metal felt 32 is heated as indicated by the heater 22B immediately prior to passage of the metal felt 32 through the press section 16B. The porosity, void volume and heat transfer specification of the metal felt 32 is equivalent to the specification and performance of a sintered plate having a pore size of at least 2 microns and a thickness of at least 0.005 inches.

FIG. 3 also shows cleaning means generally designated 34 disposed downstream relative to the press member 12B for cleaning the metal felt 32. The cleaning means 34 includes means 36 such as a pump for passing a cleaning medium through the metal felt 32 contacting the web WB so that contaminants picked up by the metal felt 32 during operation of the apparatus 10B are ejected from the metal felt 32.

Figure 4:
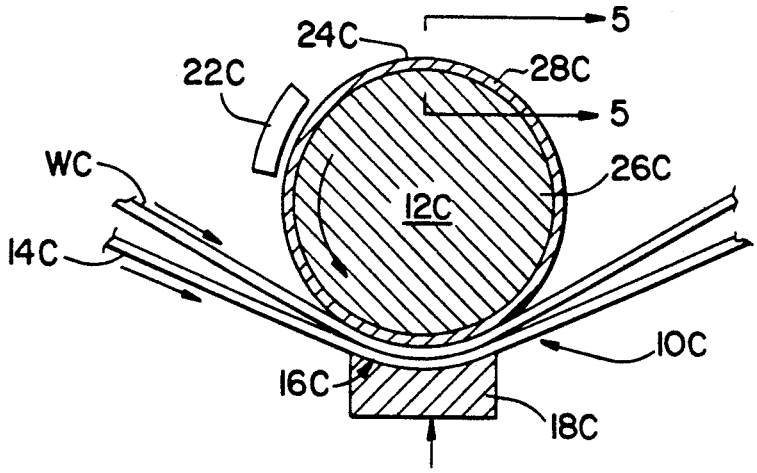
FIG. 4 is a side-elevational view of a fourth embodiment of the present invention in which the first layer is vented.
Figure 5:
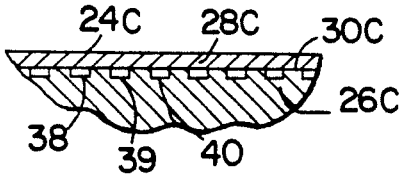
FIG. 5 is a sectional view taken on the line 5—5 of FIG. 4.

FIG. 4 is a side-elevational view of a fourth embodiment of the present invention and shows an apparatus 10C in which the first layer 26C of the press member 12C is vented such that fluid entering the pressing surface 24C passes through the second layer 28C into the first layer 26C. As shown in FIGS. 4 and 5, the first layer 26C is grooved, as shown particularly in FIG. 5 which is a section on the line 5—5 of FIG. 4. FIG. 5 shows a plurality of axially-spaced grooves 38,39 and 40 defined by the external surface 30C of the first layer 26C.

Figure 6:
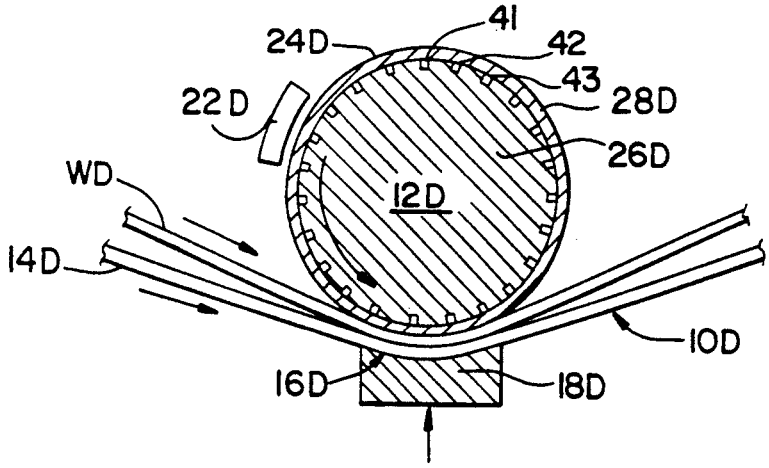
FIG. 6 is a side-elevational view of a fifth embodiment of the present invention in which the first layer is grooved.

FIG. 6 is a similar view to that shown in FIGS. 4 and 5 but shows a fifth embodiment of the present invention in which the first layer 26D is blind-drilled as indicated by the holes 41.42 and 43.

Figure 7:
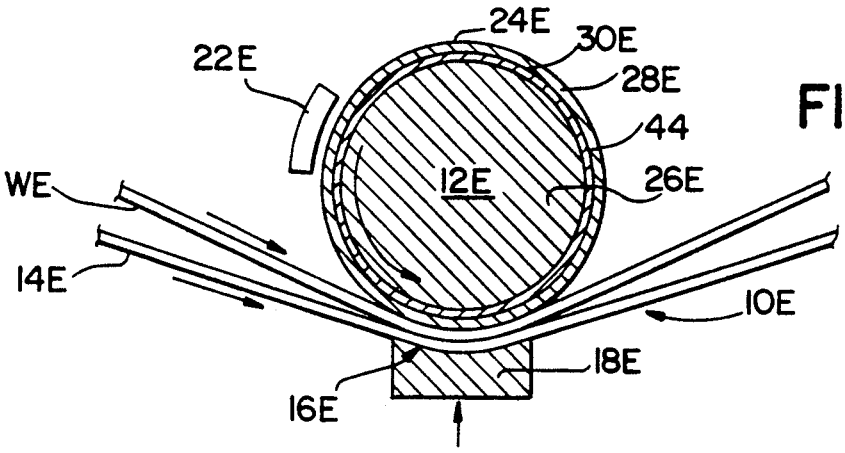
FIG. 7 is a side-elevational view of the present invention including a third intermediate layer.

In a further embodiment of the present invention as shown in FIG. 7, the heated roll, or press member 12E, includes a first layer 26E which is solid and an outer, or second, porous layer 28E having a pore size within the range 2–50 microns and preferably of 20 microns. An intermediate third layer 44 is disposed between layers 26E and 28E, the third layer 44 having a pore size within the range 50–100 microns and preferably of 100 microns such that ventilation of the second layer and the web WE is assisted.

More specifically, in the embodiment shown in FIG. 7, the second outer layer 28E has a pore size within the range 2–50 microns, and in another embodiment of the present invention, the second porous layer 28E has a porosity within the range 0.5–50 microns.

In operation of the apparatus 10, as shown in FIG. 1, the web W is conducted through the press section 16 and heat is applied, for example by inducting heating, through the heater 22 such that the press member 12 is heated. Pressure is applied as indicated by the arrow 20 such that the blanket 14 is pressed towards the pressing member 12, thereby exerting pressure on the web W as the web W passes through the pressing section 16. The combination of high pressure and high temperature for an extended period results in fluid from within the fibrous web W being vaporized such that this vapor forces fluid in the liquid phase away from the web W. Although there exists a tendency for the aforementioned force of such pressurized vapor to cause delamination in the pressed web, the present invention overcomes this problem by the provision of a porous layer 24 on the outer surface of the press member 12 such that the vapor pressure is relieved and the amount of heat transferred through the press member 12 to the web W is reduced, thereby inhibiting delamination of the web.

The operation of the embodiment shown in FIG. 2 is similar to that shown in FIG. 1; however, FIG. 2 shows a simple means of applying a porous layer 28 to the external surface of a conventional backing roll of an extended nip press.

In operation of the embodiment shown in FIG. 3, a fiber metal felt 32 is used to convey thermal energy from the heater 22B towards the pressing section 16B such that the web WB is subjected to heat and pressure during passage through the pressing section 16B. The advantage of the embodiment shown in FIG. 3 is that the pressing surface which effectively is the surface 24B of the metal felt 32 may be cleaned by means of the cleaning means 34. Also, the metal felt can be replaced more easily than a porous surface roll. Another advantage derived from the use of a metal felt is that the press member or roll will run significantly cooler, thereby alleviating problems associated with heating a controlled crown type roll.

The operation of the embodiment shown in FIGS. 4, 5, 6 and 7 is similar to that of the embodiment shown in FIGS. 1 and 2, however, the provision of a grooved (or blind-drilled) first layer permits further reduction in the force applied by the vapor in removing fluid in the liquid phase away from the web in the case of the embodiments of FIGS. 4–6. Similarly, with the embodiment of FIG. 7, the third layer 44 assists in the ventilation of the outer layer 28 and the web WE. Although this may reduce the overall amount of fluid removed from the web, such arrangements avoid the problem of delamination and thus provides a very practical and economic means for press drying a fibrous web.

What is claimed is:

1. An apparatus for removing fluid from a fibrous web, said apparatus comprising:

a press member;

blanket means cooperating with said press member for defining therebetween an elongate pressing section such that the web is pressed between said press member and said blanket means during passage through said pressing section;

a pressing shoe for urging said blanket means toward said press member such that when the web passes through said pressing section, fluid is removed from the web;

heating means disposed adjacent to said press member for transferring heat to the web and structured such that when the web passes through said press section, the web is subjected for an extended period to increased pressure and temperature so that water vapor generated within said pressing section during passage through said pressing section forces the fluid in the liquid phase away from the web;

said press member defining a pressing surface which is porous for inhibiting delamination of the web;

said press member further including:

a first solid inner layer;

a second outer layer extending around said first layer, said second layer having a pore size of between 2–50 microns; and a third intermediate layer disposed between said first and second layers, said third layer having a pore size within the range 50–100 microns such that said third layer assists in ventilating said second layer and the web.

2. An apparatus as set forth in claim 1 wherein said pressing surface is cylindrical.

3. An apparatus as set forth in claim 1 wherein said second layer is sintered.

4. An apparatus as set forth in claim 3 wherein said second layer has a thickness of at least 0.005 inches.

5. An apparatus as set forth in claim 2 wherein said first layer is vented such that fluid entering said pressing surface passes through said second layer into said first layer.

6. An apparatus as set forth in claim 5 wherein said first layer is grooved.

7. An apparatus as set forth in claim 5 wherein said first layer is blind-drilled.

* * * * *